United States Patent [19]

Williams

[11] 4,064,857

[45] Dec. 27, 1977

[54] IRIS THROTTLE ADAPTOR

[75] Inventor: David R. Williams, Savannah, Ga.

[73] Assignees: William O. Plunkett; Robert E. Reavis, both of Savannah, Ga. ; part interest to each

[21] Appl. No.: 679,312

[22] Filed: Apr. 22, 1976

[51] Int. Cl.[2] ..... F02M 29/00

[52] U.S. Cl. ..... 123/141; 261/23 A; 261/65

[58] Field of Search ..... 123/141; 261/23 A, 65; 48/180 R

[56] References Cited

U.S. PATENT DOCUMENTS

| | | | |
|---|---|---|---|
| 772,530 | 10/1904 | McGee | 123/141 |
| 1,042,982 | 10/1912 | Sliger | 261/65 |
| 1,165,224 | 12/1915 | Cadett | 261/65 |
| 1,221,702 | 4/1917 | Douglas | 261/65 UX |
| 1,243,122 | 10/1917 | Winters | 261/65 X |
| 1,312,040 | 8/1919 | Merciel | 261/65 |
| 1,829,632 | 10/1931 | Chanard | 261/65 |
| 2,597,780 | 5/1952 | Engnath | 261/23 A |
| 2,735,664 | 2/1956 | Gamble | 261/23 A |
| 2,783,981 | 3/1957 | Briggs | 261/23 A |
| 3,682,449 | 8/1972 | Severn | 261/23 A |

*Primary Examiner*—Ronald H. Lazarus
*Assistant Examiner*—Ira S. Lazarus
*Attorney, Agent, or Firm*—Clarence A. O'Brien; Harvey B. Jacobson

[57] ABSTRACT

An adaptor for a conventional type carburetor having a main support plate provided with central apertures therein, a slotted throttle plate movable longitudinally in the apertures, support and retaining plates on either side of said movable throttle plate slidable therebetween, and pivotable lever means attachable to the conventional throttle linkage for actuation of the slotted throttle plate to increase or decrease the flow of partially atomized gasoline and air through the slotted apertures of the aforementioned plates and to further break down and additionally atomize the gasoline particles due to the action of the cutting edges. This adaptor may be used with conventional carburetors and/or used as the primary throttle control for new carburetion systems.

11 Claims, 4 Drawing Figures

IRIS THROTTLE ADAPTOR

BACKGROUND OF THE INVENTION

1. Field of the Invention

This invention relates generally to throttle control apparatus for carburetors of internal combustion engines and specifically to controls which can accurately vary and affect the amount of atomized gasoline flowing to the manifold of an internal combustion engine.

2. Description of the Prior Art

A common problem with known throttle control apparatus for carburetors is that they fail to be accurate and precise in their manner of control.

Another problem is that they tend to waste gasoline and increase gasoline consumption in the engines with which they are normally associated.

Another problem with known type throttle controls is that they do not offer any additional atomization or breaking up of the suspended gasoline particles as atomized and drawn into the carburetor through the conventional venturi system.

Another problem with known type carburetion systems is that they tend to increase the pollutions emitted by the internal combustion engines with which they are used and do not help to reduce such pollution.

Known prior art patents which may be pertinent to this invention are as follows: E. E. Richardson, U.S. Pat. Nos. 1,270,327, June 25, 1918, E. F. Ciglia and L. F. Pelletier, 1,375,898, Apr. 25, 1921, C. Brown, 1,422,413, July 11, 1922, A. E. Raque et al, 1,624,281, Apr. 19, 1927, H. H. Timian, 1,897,540, Feb. 14, 1933, E. R. Schneider, 2,684,059, July 20, 1954. None of these known prior art devices offers the new and unique features of the invention disclosed herein.

SUMMARY OF THE INVENTION

An object of the present invention is to provide an iris throttle adaptor for use with new carburetion equipment and/or for use with conventional existing type carburetors.

Another object of the present invention is to provide an iris type throttle which will be usable with existing type carburetors as a replacement for the conventional throttle plate system and will increase the atomization of the suspended fuel in the air/gas mixture passing past and through the throttle iris itself.

A further object of this invention is to provide an iris throttle adaptor which will improve the atomization of the air/fuel mixture passing therethrough and thereby provide quicker starting of the internal combustion engine with which it is used, provide better gas burning efficiency of the engine, and reduce the pollutants exhausted by said engine.

The iris throttle adaptor of this invention greatly improves the efficiency and operation of conventional type carburetors with which it is used. It is readily attached to such carburetion systems and greatly increases the break-up and atomization of the gasoline particles in the air/fuel mixture passing through the apparatus into the manifold of the internal combustion engine.

By increasing the efficiency of break-up and atomization of the liquid gasoline particles many desirable benefits are achieved. Namely increased gasoline mileage, quicker starting in all weather conditions, reduced air pollution and cleaner combustion, and greatly increased efficiency of the internal combustion engine itself.

The device is also usable in the new construction of carburetors as a direct replacement for the more conventional type throttle plate structure as presently constructed and assembled.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
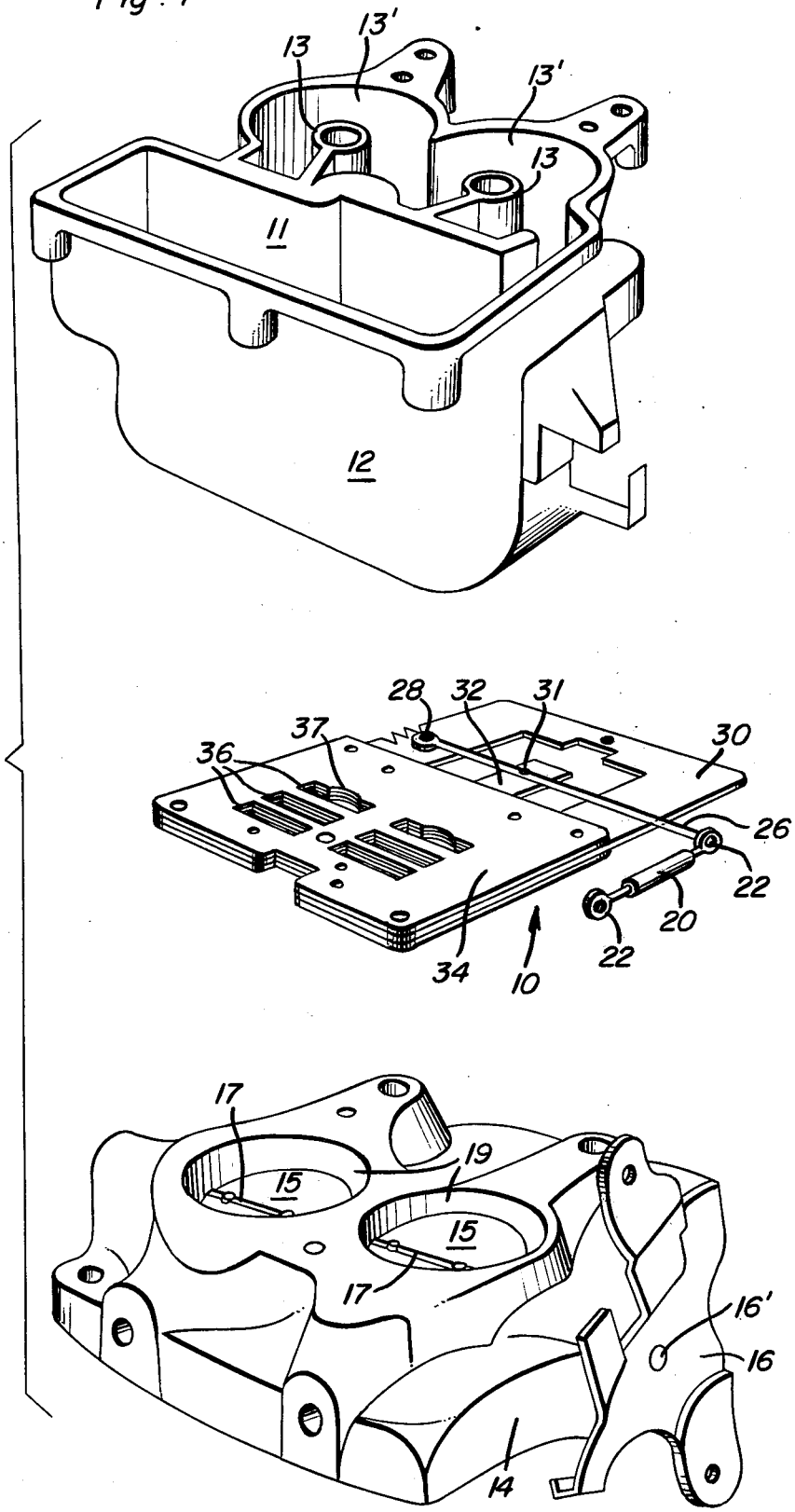
FIG. 1 is an exploded perspective view of a conventional type carburetor of the down draft type as being modified to include the iris throttle adaptor of this invention.

Referring to FIG. 1 of the drawings, reference numeral 10 indicates the iris throttle adaptor of this invention as normally positioned between the main body portion of a carburetor 12 and the lower throttle body and manifold connection portion 14. A conventional throttle plate 15 actuating structure 16 is shown mounted on the side of carburetor structure 14. The main body 12 has a gasoline chamber 11, venturi structure 13 mounted in the air passageways 13', together with the conventional type gasoline jets, passageways, etc., as normally required for such carburetors.

Normally the throttle member 16 controls the conventional circular or disk-like throttle plates 15 mounted within the carburetor structure. However, when a carburetor is modified for use with the iris throttle adaptor of this invention, these disk throttle plates 15 will be removed and only the actuating member 16 retained. The member 16 is then appropriately tapped to provide a connecting point for end 22 of the linkage 20 of this adaptor. As shown in FIG. 1, the linkage 20 has adjustable portions 22 at each end thereof for engine idle adjustment purposes. This linkage connects in turn with a pivot lever 26 mounted about a pivot point 28 on the main support plate 30. In turn this lever is pivotally connected by pin 31 to the slidable throttle plate 32 of this invention. The main support plate 30 is provided with suitable apertures therein for reception and retention of the movable throttle plate 32 to be described and elaborated on below. Additionally, retention and support plates 34 are provided, on either side of the main support plate 30, with said additional support plates having rectagular apertures 36 provided therein and with one of the apertures 36 having a semi or partial moon shaped recess 37 along one longitudinal side thereof. Such semi-circular recesses may or may not be provided on one or more of the rectangular apertures.

Looking now at FIGS. 2, 3 and 4, which are views looking up from the bottom of the adaptor as shown in FIG. 1, this adaptor will be described in greater detail.

Figure 3:
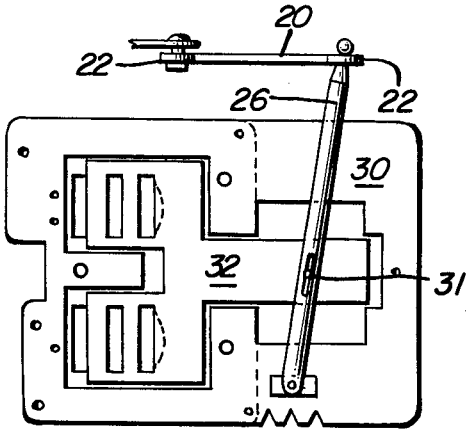
FIG. 3 is another plan view from the bottom, showing the adjustable throttle plate in a different position.
Figure 4:
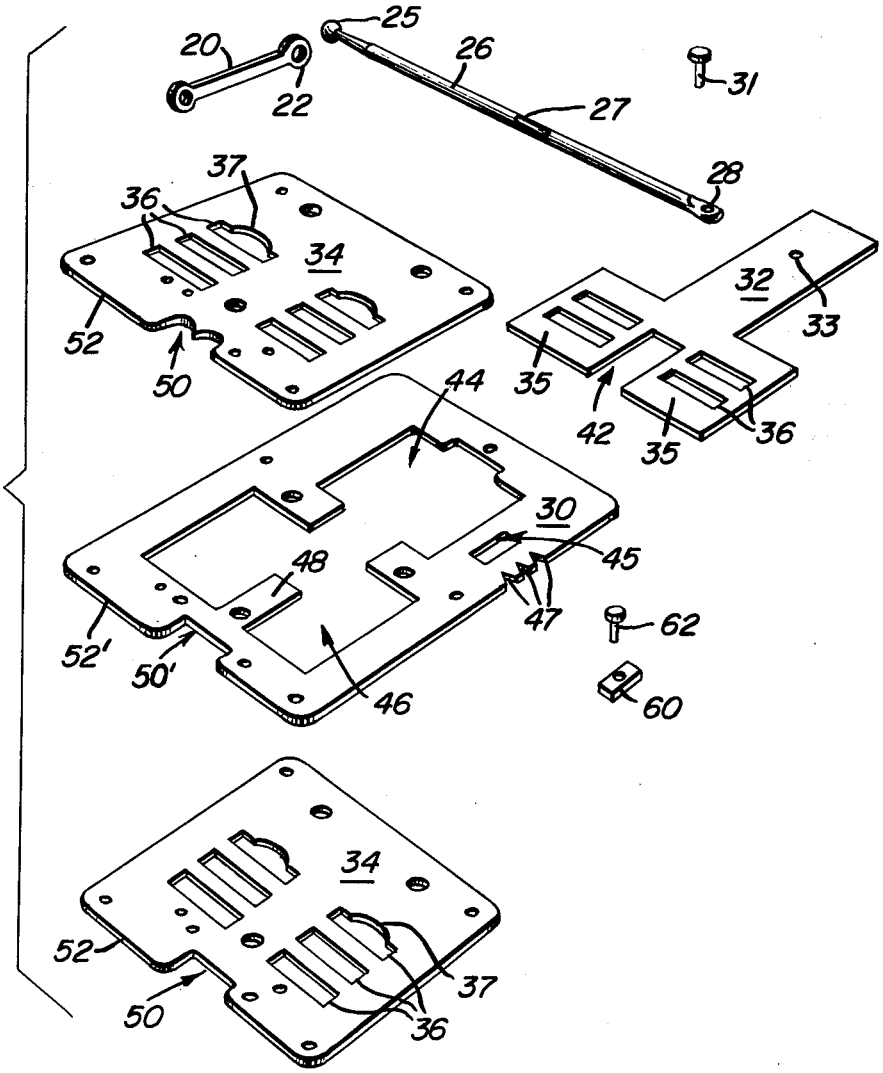
FIG. 4 is an exploded perspective view of the component parts of the iris throttle adaptor by itself, again as inverted from the depictation of FIG. 1.

Looking at FIG. 4, the main component parts of the iris throttle adaptor are shown as separated. The linkage attachment member 20 with apertured ends 22 provided thereon is shown in this Figure as a single, non-adjustable member, but, as already mentioned, it may have adjustable end portions provided thereon as shown in FIG. 1. The pivot lever 26 is provided with a ball head attachment 25 or the like at one end thereof and a pivot connection 28 at the other end. A slot 27 is also provided for slidable and pivotal engagement with pin 31 and the slidable throttle plate. In FIGS. 2, 3 and 4, the pivot lever 26 is shown on the opposite side of the plate 30 from that of FIG. 1. The lever 26 may be mounted interchangably on either side depending on the particular make of carburetor with which the adaptor is being used.

The main support plate 30 has provided therein central apertures 44, 45 and 46. The apertures 44 and 46 are for reception of the slidable throttle plate 32 while the aperture 45 is provided to receive the pivot connection 28, by means of a pivot block or the like appropriately mounted therein. This pivot block 60 of heat resistant material and appropriately apertured and threaded for reception of a retaining bolt 62, is indicated in FIG. 4. Locator recesses or notches 47 are also provided adjacent thereto along the outer edge of the main support plate 30. The aperture 46 of the main support has a projection 48 extending into the mid-portion thereof for alignment and guiding purposes with and for the throttle plate. The throttle plate 32 is basically in the shape of a T with the head portions 35 forming the top of the T. A guiding and alignment recess 42 is appropriately provided midway along the top of the T section for reception of the projection 48. An aperture 33 is also provided to receive the pin 31 which passes through the pivot and slide slot 27 of the actuating lever 26. Thus, as can be readily visualized by looking at FIG. 4, and as shown in FIGS. 2 and 3, the movement of pivot lever 26 will, through the pin 31, actuate and effect longitudinal slidable movement of the throttle plate 32 within the apertures 44 and 46 of the main support plate 30. The alignment guide projection 48 in the slot 42 will maintain the proper relationship of the throttle plate to the rest of the structure.

Retention and cover plates 34 are appropriately mounted on either side of the main support plate 30 for operative association with the slidable throttle plate 32. These plates 34 have rectangular apertures 36 provided therein with two pairs of these apertures being shown for the double carburetor application as shown. One of the rectangular apertures on each set may be provided with a small partial moon shaped recess 37 for permitting fine and accurate high speed throttle operating conditions. Appropriate mounting and connecting holes are provided in the various plates as necessary to fasten same securely together with the necessary passageways for air and gasoline flow to the carburetor halves. This will vary from carburetor to carburetor depending on the make and model and whether of conventional construction, and/or new manufacture. Recesses 50 and 50' are also provided external of the plates for similar reasons as are the projections 52, 52' which extend further from the plates than the opposite sides thereof.

Figure 2:
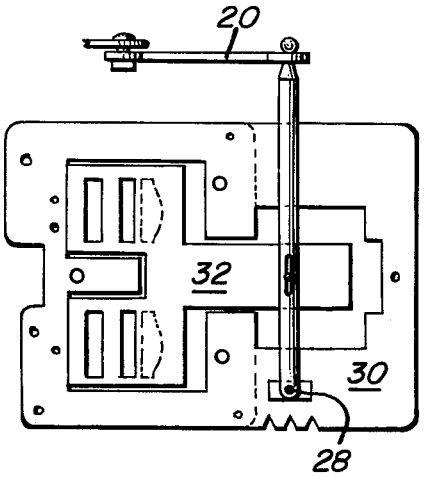
FIG. 2 is a plan view, as viewed from the bottom, of the iris throttle adaptor per se.

Looking at FIGS. 2 and 3, it can be seen how the slidable throttle plate and the rectangular apertures therein will partially open or fully open the aligned apertures of the two cover plates 34. Obviously, at full throttle conditions the maximum opening will occur while at idle or reduced throttle position only a small portion of the recesses are open.

The throttle has been designed to be used on four cycle gasoline engines such as the type that are normally provided in automobiles, used in industrial equipment and applications, and auto-marine type engines, This adaptor can be used with most all past and present engine arrangements using carburetors. In the future, it can be built into the throttle base of new carburetors.

The structure described here has been used with conventional type single, double and four barrel carburetors and used on, large capacity, automobile engines for a mileage test of better than six thousand miles. The results of this test indicate greatly improved performance, efficiency and better gasoline mileage, all achieved with less air pollution.

The iris throttle adaptor of this invention provides a total of eighteen cutting edges which replace the single or double conventional type carburetor throttle plates. The throttle is enclosed in a housing with all manifold vent lines drilled in place to match the carburetor being modified. Installation requires the removal of the throttle body assembly, the removal of the present throttle disk plates 15, the cutting of the throttle shaft 17 to clear the vent openings 19, the drilling and tapping of the shaft, the placing of a retaining screw on the inside of the shaft to hold the linkage end 16' of the shaft in place in order to retain the throttle plate 16 actuator rotatably attached to the carburetor, and a plug on the opposite portion of the carburetor where the shaft has been removed.

The iris throttle adaptor is then placed between the modified throttle body assembly 14 and the main body assembly 12 using conventional carburetor body gaskets. The bolts are then replaced to hold the two carburetor sections together. An air horn structure, not shown, would normally also be used as is conventional.

The throttle plate actuator 16 is then drilled in order to place a linkage ball on the outside of said plate at approximately a one inch distance from the shaft pivot point 16' thereof.

The carburetor is then replaced on the internal combustion engine and the throttle plate 32 is adjusted for an idle speed which is approximately fifteen one thousandths of a inch of aperture opening. The mechanic then bottoms the low and high speed jets of the carburetor and then opens them about three fourths of a turn. All other factory specifications for the engine should be complied with, i.e. such as engine timing, spark plug gaps, etc. The installation is now complete and the operator is ready to reap the benefits of this new and improved throttle control structure.

One of the important features and purposes of this invention is to further atomize the fuel passing from the carburetor venturis through the new throttle structure before entering the intake manifold of the internal combustion engine. The eighteen cutting edges of the slidable throttle plate together with the cover plate apertures effect this function. The overall results are increased gasoline mileage, better starting conditions under all weather extremes, better atomization and break-up of the fuel, and more efficient combustion within the internal combustion engine to reduce the exhaust pollutants thereof.

The foregoing is considered as illustrative only of the principles of the invention. Further, since numerous modifications and changes will readily occur to those skilled in the art, it is not desired to limit the invention to the exact construction and operation shown and described, and accordingly all suitable modifications

United States Patent [19]

Forde

[11] 4,064,858

[45] Dec. 27, 1977

[54] IGNITION SYSTEM WITH MULTIPLEX DISTRIBUTOR FOR ENGINES

[76] Inventor: Louis Forde, 482 Berriman St., Brooklyn, N.Y. 11208

[21] Appl. No.: 750,274

[22] Filed: Dec. 13, 1976

Related U.S. Application Data

[63] Continuation-in-part of Ser. No. 665,125, Aug. 5, 1976, abandoned, which is a continuation-in-part of Ser. No. 482,232, June 24, 1974, abandoned.

[51] Int. Cl.[2] ..... F02P 1/00; F02P 5/04; H01H 29/16

[52] U.S. Cl. ..... 123/148 DS; 123/117 R; 123/148 C; 123/146.5 A; 200/19 R

[58] Field of Search ..... 123/117 R, 146 SA, 148 DS, 123/148 C; 200/19 R, 19 DR, 19 DC

[56] References Cited

U.S. PATENT DOCUMENTS

| | | | |
|---|---|---|---|
| 2,215,106 | 9/1940 | LeFebre | 123/148 DS |
| 2,285,107 | 6/1942 | Bohli | 123/148 DS |
| 2,756,268 | 7/1956 | Knudson | 123/148 DS |
| 3,577,963 | 5/1971 | Bechmann | 123/117 R |
| 3,890,947 | 6/1975 | Shibagaki | 123/148 DS |

FOREIGN PATENT DOCUMENTS

| | | | |
|---|---|---|---|
| 43-17125 | 10/1965 | Japan | 123/148 DS |

*Primary Examiner*—Ronald B. Cox

[57] ABSTRACT

An ignition distributor is described for use in an internal combustion engine which has a plurality of cylinders or combustion chambers. The distributor includes a driving shaft with a number of rotatable cams mounted on the shaft in an axially spaced arrangement. Each of the cams have lobes on them. A corresponding plurality of substantially identical and concurrently operable circuit breaker assemblies are disposed in an axially spaced apart arrangement. A multi-level rotor is positioned on the shaft, with each level associated with a respective one of the circuit breaker assemblies. An ignition coil is provided for each assembly. The primary of the ignition coil is connected to a respective one of the circuit breaker assemblies and the secondary is connected through the corresponding level of the rotor to a spark plug. Each assembly includes an actuating cam follower, and all of the cam followers are pivoted about the same pivot line and onto a common ground plate. Each cam follower engages a respective one of the rotatable cams.

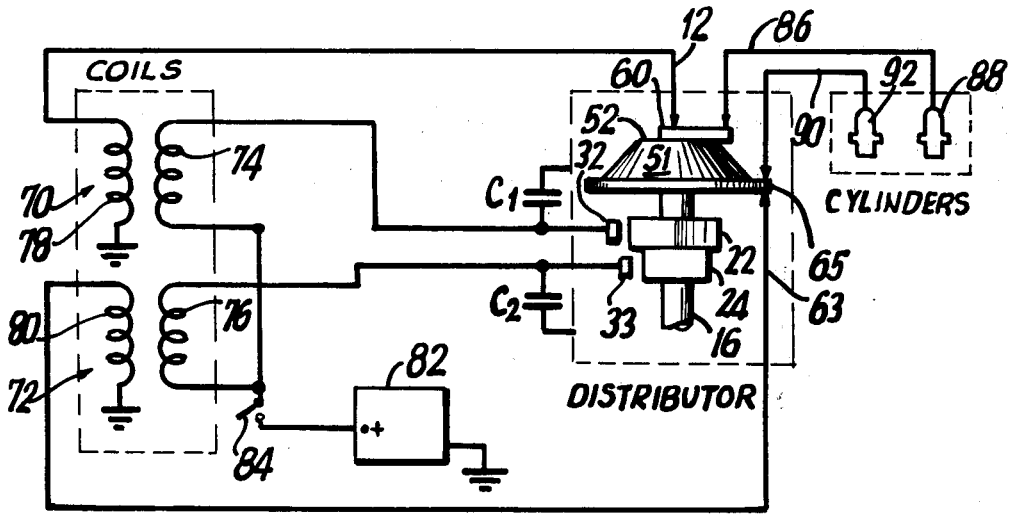

12 Claims, 16 Drawing Figures